US006802627B2

(12) United States Patent
Fischer et al.

(10) Patent No.: US 6,802,627 B2
(45) Date of Patent: Oct. 12, 2004

(54) DIRECTIONAL LUMINAIRE

(76) Inventors: Jerry F. Fischer, 8227 Paddington Ct., West Chester, OH (US) 45069; Larry A. Akers, 105 Taylor La., Clarksville, OH (US) 45113

( * ) Notice: Subject to any disclaimer, the term of this patent is extended or adjusted under 35 U.S.C. 154(b) by 0 days.

(21) Appl. No.: 10/329,808

(22) Filed: Dec. 26, 2002

(65) Prior Publication Data

US 2004/0124792 A1 Jul. 1, 2004

(51) Int. Cl.[7] ..... F21V 21/26

(52) U.S. Cl. ..... 362/269; 362/372; 362/282; 362/287; 362/365; 362/378; 315/56

(58) Field of Search ..... 315/56, 58, 61; 362/269, 282, 287, 364, 365, 372, 374–378, 217, 233, 240, 243, 250

(56) References Cited

U.S. PATENT DOCUMENTS 3,974,371 A 8/1976 Miles, Jr.
4,947,297 A * 8/1990 Druffel et al. ..... 362/147
5,121,309 A * 6/1992 Ewing et al. ..... 362/226
5,145,249 A 9/1992 Bruckner
5,398,177 A * 3/1995 Harwood ..... 362/270
5,609,413 A 3/1997 Lecluze
5,630,663 A 5/1997 Ling
6,149,280 A * 11/2000 Quiogue et al. ..... 362/147
6,290,376 B1 9/2001 Gutierrez
6,461,016 B1 * 10/2002 Jamison et al. ..... 362/147

* cited by examiner

*Primary Examiner*—Haissa Philogene

(57) ABSTRACT

A directional luminaire having a door frame, a lamp shroud, and a lampholder socket attached to a luminaire structure. The luminaire is wired, either directly or indirectly, to provide an electrical connection to a lampholder socket configured to receive a lamp. The lamp shroud has an opening from which the light output is directed. Further, the rim edge of the lamp shroud and retaining lip of the door frame interact to permit substantially complete rotation of the lamp shroud and lamp.

18 Claims, 6 Drawing Sheets

DIRECTIONAL LUMINAIRE

FIELD OF THE INVENTION

This invention relates generally to luminaires and more particularly to luminaires providing directional lighting.

BACKGROUND OF THE INVENTION

Luminaires are typically mounted on or within a support structure, such as a ceiling, wall, soffit, canopy structure or building exterior. They are used in many commercial and consumer applications to illuminate particular areas of a site.

Luminaires of currently existing designs are typically mounted on their support structures either by direct attachment to the structure or by creating an opening and installing the recessed luminaire into the opening. A drawback associated with many existing luminaires is that the lamp is mounted in a fixed position on or within the support structure. This prohibits redirection of the light emanating from the lamp toward specific, desired areas below the light. Although lenses can be used to direct the light toward a particular area and focus the light output downward, a substantial portion of the luminous output of the lamp is nevertheless emitted in other directions. Further, although a particular lens could be designed to direct light for a singular purpose, any change in the area below the light would require difficult and costly adjustment of the light to adapt to the new area.

Some existing luminaires permit movement of the luminaire body to direct the light output, most notably track lighting. However, existing luminaires are not designed to withstand outside environments, such as weather and insects. Further, many have limitations in the rotational range of the lamps and cannot be easily locked into place.

Another common problem is the amount of electricity consumed by the lamp and the complexity of the lamp's electrical system. While a variety of types of lighting lamps can be used, including common fluorescent and incandescent lamps, luminaires in commercial applications often use high intensity discharge (HID) lamps to provide the desired level of lighting. The use of HID light sources can have many drawbacks. HID light sources are regulated by control gear, which may include a ballast alone or in combination with other components such as capacitors, igniters, or other such equipment. This control gear may be as large as or larger than the lamp itself. Further, the lamp and control gear are frequently contained within a box-like housing, which must be mounted to the support structure. HID light sources also use more electricity than lighting alternatives.

A further drawback associated with existing luminaires is the difficulty in directing the light output toward the intended area thereby necessitating use of a larger lamp, such as a HID lamp, than would otherwise be required. As the lens cannot efficiently direct the light to specific areas, much of the light is scattered toward unintended local and distant destinations. This scattering results in light pollution issues ranging from the disturbance of neighbors to interference of night sky viewing.

Thus, there is a substantial need for a luminaire that may be easily and quickly adjusted to direct light toward a particular target area without scattering light to unintended areas. Further, there is a significant need for a luminaire that is capable of using a smaller lamp and consuming less electricity in its operation while providing the same degree of illumination.

SUMMARY OF THE INVENTION

The present invention provides a luminaire which overcomes drawbacks associated with the currently existing luminaires. More specifically, the luminaire comprises a door frame attached to a luminaire support structure, a rotatable lamp shroud disposed within and attached to the door frame and a lampholder socket disposed within the lamp shroud. The door frame is typically disposed on the underside of the support structure, either by being attached directly to the support structure or supported by other elements of the support structure located above the structure. The lamp shroud has at least one opening, and is opaque and designed to avoid emission of any light from the shroud except through an opening. The opening can be disposed non-perpendicularly to the support structure. The lampholder socket is disposed in such a location as to direct the light from the lamp in the socket through the opening in the lamp shroud, either directly or via use of reflectors. The lampholder socket is electrically connected to a power source either directly or through the use of a socket adapter having a male end that can be inserted into an existing lampholder socket disposed near or above the door frame. The lamp holder socket has an electrical contact and is sized to receive the base of a lamp, and can be electrically connected to the base of the lamp when the lamp base is inserted therein. The lamp is held in place using retaining clips and the lamp itself can be directed at different angles relative to the opening by using tabs to lift the lamp if desired. Further, the opening is typically covered with a transparent or translucent material such as a glass or plastic lens to shield the interior environment of the shroud from the outside environment and a baffle is also disposed next to the lens material, and is located on top of the lens inside the lamp shroud, to reduce scattering of the light. Optionally, one or more reflectors can be disposed adjacent to the lamp to further increase the efficient direction and output of the lamp. The one or more reflectors surround the lamp and direct the light output from the lamp out of the opening. In an alternative embodiment, the lamp can be positioned in a substantially vertical position within the shroud, and the one or more reflectors can surround the lamp and direct the light output from the lamp out of the opening.

The rim edge of the lamp shroud extends beyond the retaining lip of the door frame, thereby permitting rotation of the shroud within the frame. Stops are used on the shroud and door frame to restrict rotation of the shroud to a single 360° rotation thereby avoiding the tangling of the electrical connections while still providing complete rotational movement of the luminaire. The shroud rim edge and frame retaining lip also use a locking mechanism to prevent rotation of the shroud after it is positioned in the optimal position. In one embodiment the locking mechanism is a clamp which can be loosened or tightened by turning a bolt on the bottom of the door frame.

Further to another aspect of the present invention, the door frame is attached to the support structure via attachment mechanisms. One common mechanism for attachment includes hinges at one end and a spring clasp attached at a second end, opposite the first end, permitting the door frame to swing between an open position and a closed position. The pivoting door frame permits easy replacement of the lamp and access to the interior of the shroud.

The present invention can also be retrofit to existing luminaires. The present invention includes a method of installing a retrofit directional luminaire assembly in an existing luminaire, the retrofit directional luminaire having a door frame attached to a support structure, a rotatable lamp shroud attached to the door frame, and a lamp socket disposed within the lamp shroud and sized to receive a lamp, comprising: removing an existing door assembly from the support structure to expose the interior of the luminaire housing; removing any existing lamp and reflector from the structure; providing a door frame having a lamp shroud with at least one opening disposed therein; providing a lamp socket within the lamp shroud sized to receive the base of a lamp, the lamp socket being electrically connected to an electrical power source and being electrically connectable to the base of the lamp when the lamp base is inserted therein; providing a lens within the opening that encloses the shroud; engaging the pivot member on the flange surrounding the door frame for removably suspending the door frame in a substantially vertical, inoperative position; coupling a set of electrical leads from the power source to the lamp socket; pivoting the door frame to a horizontal, operative position whereby the door frame substantially closes against the structure; and securing the door frame in the horizontal, operative position.

The present invention also provides a method of installing a retrofit directional luminaire assembly in an existing luminaire housing, the retrofit directional luminaire assembly having a door frame attached to a support structure, a rotatable lamp shroud attached to the door frame, and a lamp socket disposed within the lamp shroud and sized to receive a lamp, comprising: removing an existing door assembly from the luminaire support structure to expose the interior of the housing; removing any lamp and reflector from the structure; providing a door frame having a lamp shroud with at least one opening disposed therein; providing a lamp socket within the lamp shroud sized to received the base of a lamp, the lamp socket having an electrical contact being connected to an electrical power source and being electrically connectable to the base of a lamp when the lamp base is inserted therein; providing a lens within the opening for enclosing the shroud; engaging the pivot member on the flange surrounding the door frame for removably suspending the door frame in a substantially vertical, inoperative position; coupling the original housing lamp socket to the lamp socket using an adapter; pivoting the door frame to a horizontal, operative position whereby the door frame substantially closes against the structure; and securing the door frame in the horizontal, operative position. The opening can be formed in the horizontal support structure prior to inserting the luminaire support structure therein. The temporary retainer can solely hold up the luminaire support structure after the holding step and prior to the fixedly securing step.

For an old luminaire with a similar structure, the old door assembly can be removed by prying the door hinge keepers off and removing the existing door from the luminaire housing. The new door frame and lamp shroud are then installed on the hinges and new hinge keeps are installed. For an old luminaire with a more traditional structure, the lens or luminaire bowl can be removed and appropriate attachment mechanisms can be used to attach the door frame to the structure, such as hinge receivers or fasteners that directly attach the door frame to the structure. In either case, the lamp and lampholder socket can be electrically connected to the existing luminaire either by using a male adapter to connect the lampholder socket to the pre-existing luminaire socket or simply directly wiring the lampholder socket into the pre-existing electrical circuit. The connection between the lampholder socket and its electrical source includes wiring of sufficient length to allow 360° rotation of the shroud.

The present invention further relates to a method of installing a luminaire assembly having a door frame attached to a luminaire support structure, a rotatable lamp shroud attached to the door frame, and a lamp socket disposed within the lamp shroud and sized to receive a lamp, and having a housing having a temporary retainer and an electrical connection comprising: inserting the housing of the light fixture to a horizontal support structure with the housing inserted from below the structure upwardly into an opening in the structure; engaging the housing with the temporary retainer on the structure; holding the housing in the opening with the temporary retainer during installation of the luminaire; coupling the electrical connection on the lamp socket to an electrical power source; fixedly securing the housing to the structure from above the panel after the engaging and the holding steps; providing a door frame having a lamp shroud with at least one opening disposed therein; providing a lamp socket within the lamp shroud sized to received the base of a lamp, the lamp socket having an electrical contact and being electrically connectable to the base of a lamp when the lamp base is inserted therein; providing a lens within the opening for enclosing the shroud; engaging the pivot member on the flange surrounding the door frame for removably suspending the door frame in a substantially vertical, inoperative position; coupling a set of electrical leads from the power source to the lamp socket; pivoting the door frame to a horizontal, operative position whereby the door frame substantially closes against the structure; and securing the door frame in the horizontal, operative position. The opening can be formed in the horizontal support structure prior to inserting the luminaire support structure therein. The temporary retainer can solely hold up the luminaire support structure after the holding step and prior to the fixedly securing step.

By virtue of the foregoing, there is thus provided a luminaire that permits easy and quick direction of its light output toward a particular area. Additionally, the light output of the luminaire can be easily redirected to another target area through rotation of the luminaire shroud. Additionally, the efficiencies of the luminaire permit use of a lower wattage or smaller type of lamp, thereby reducing usage of electricity while preserving usable light output. Further, the luminaire reduces local and distant light pollution. Still further, the luminaire is adapted to enable a single individual to quickly and easily replace the lamp, access the shroud interior, and redirect the luminaire.

These and other objects and advantages of the present invention shall become apparent from the accompanying drawings and the detailed description thereof.

BRIEF DESCRIPTION OF THE DRAWINGS

The accompanying drawings, which are incorporated in and constitute a part of this specification, illustrate embodiments of the invention and, together with a general description of the invention given above, and the detailed description given below, serve to explain the principles of the invention.

DETAILED DESCRIPTION OF THE DRAWINGS

Figure 1:
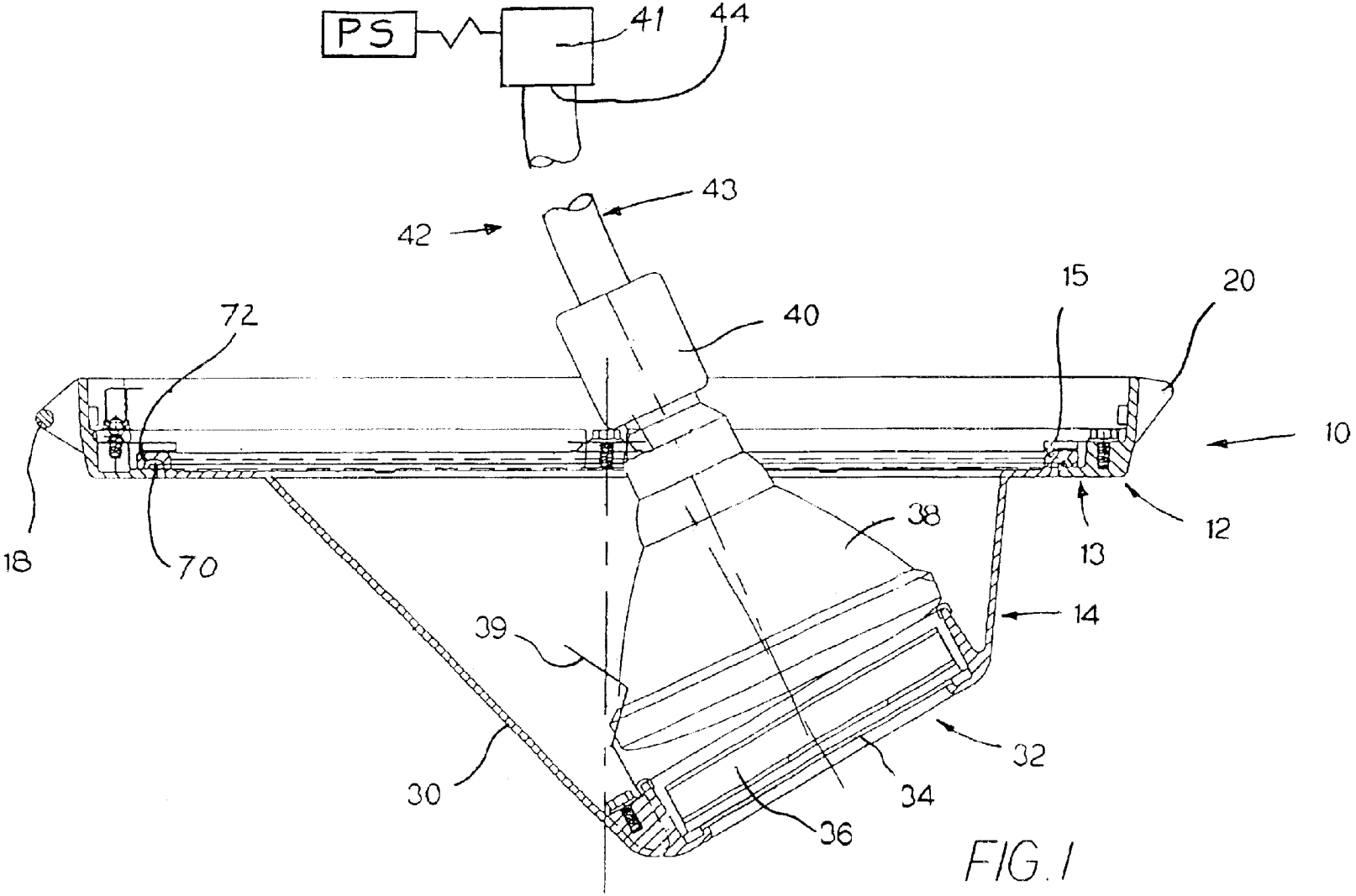
FIG. 1 is a partial cross sectioned side view of the luminaire in accordance with the principles of the present invention.
Figure 3:
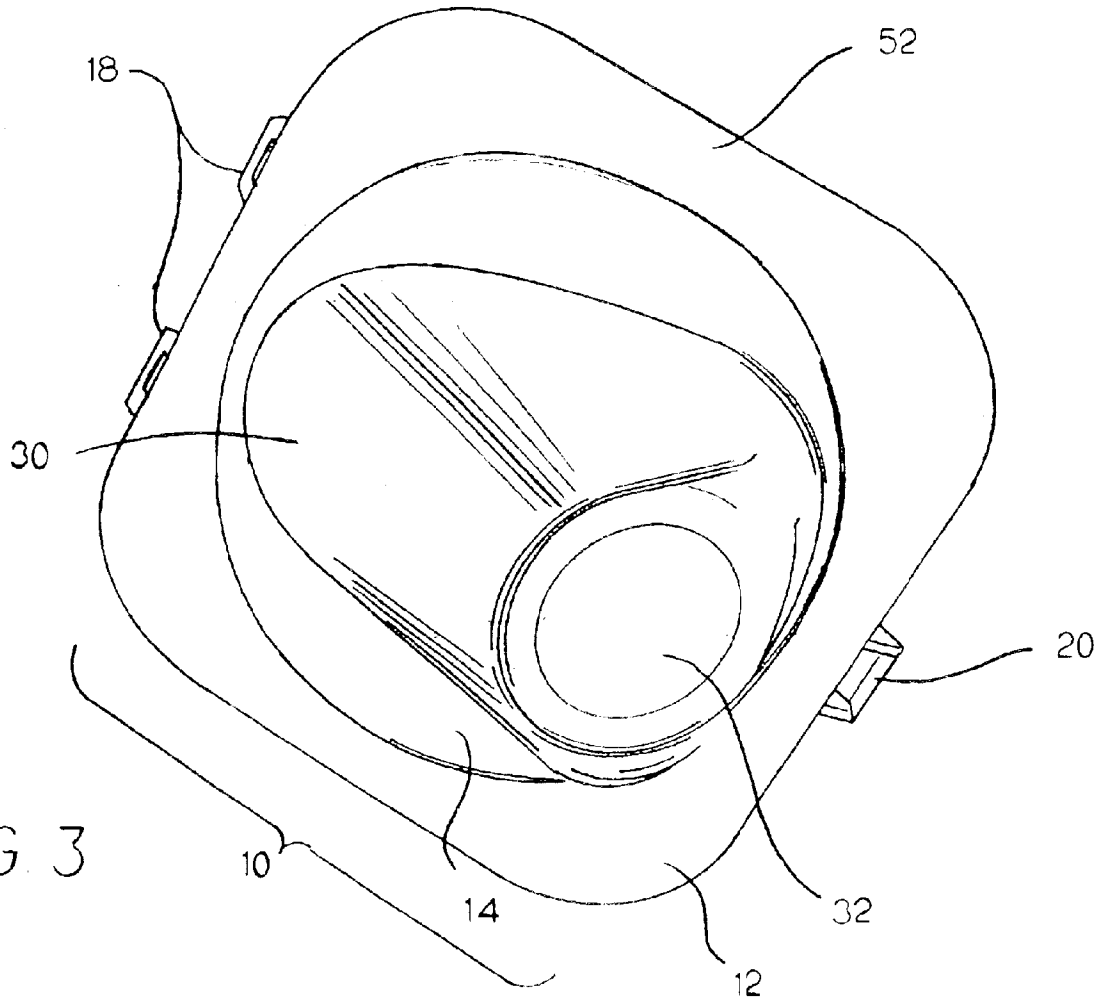
FIG. 3 is a bottom perspective view of the luminaire.
Figure 4:
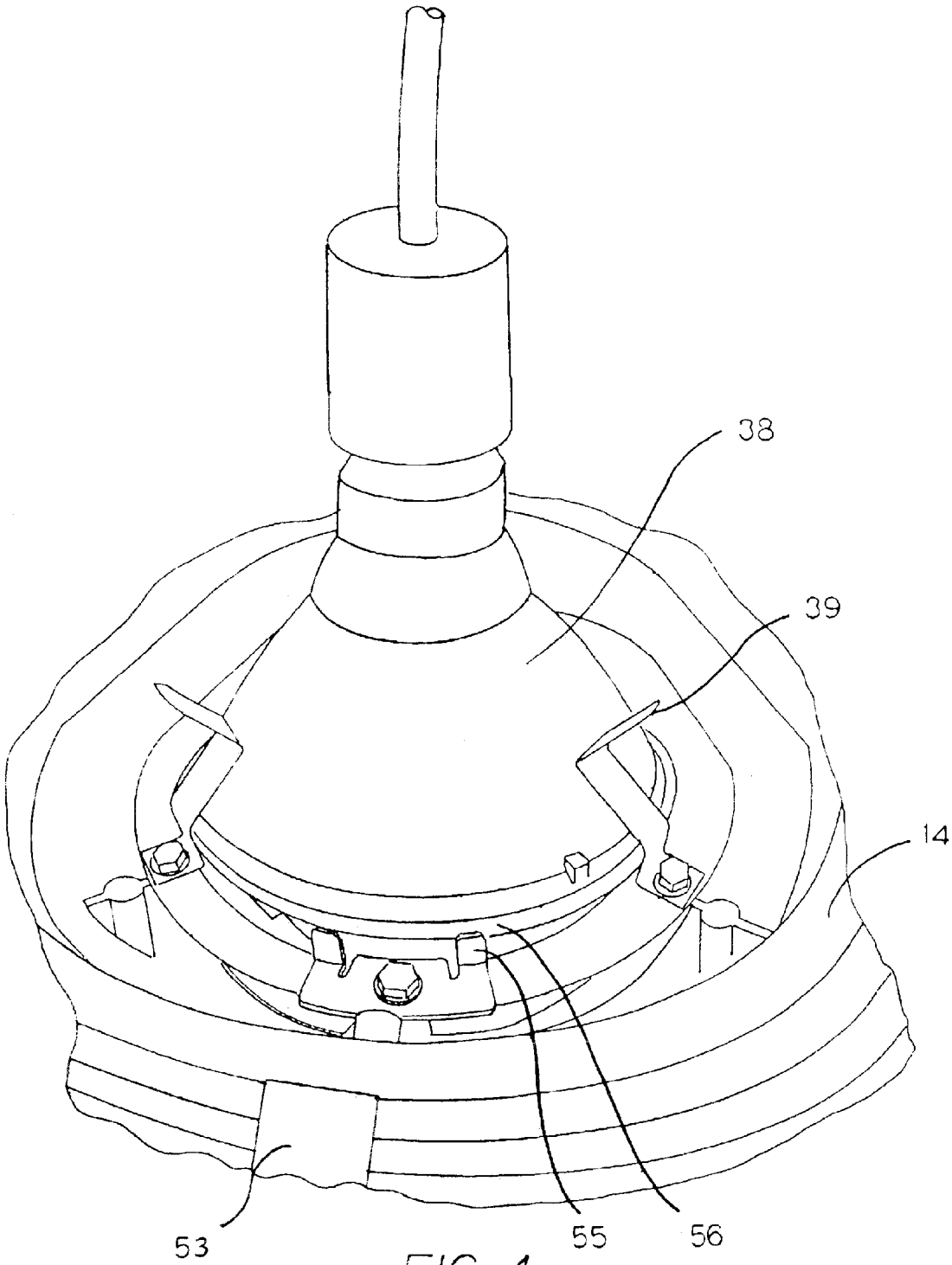
FIG. 4 is a perspective view of a lamp in the shroud.
Figure 5:
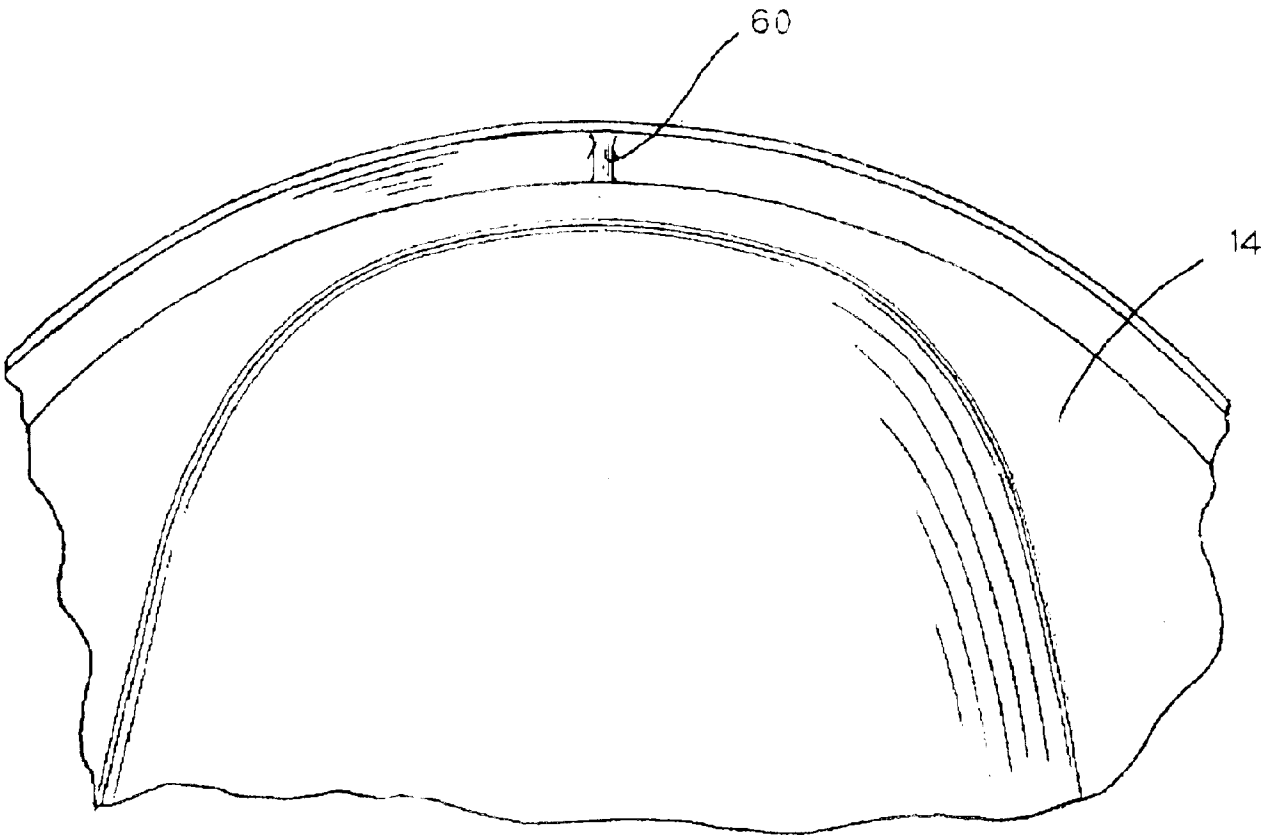
FIG. 5 is a top plan view of a portion of the rim edge of the shroud.
Figure 6:
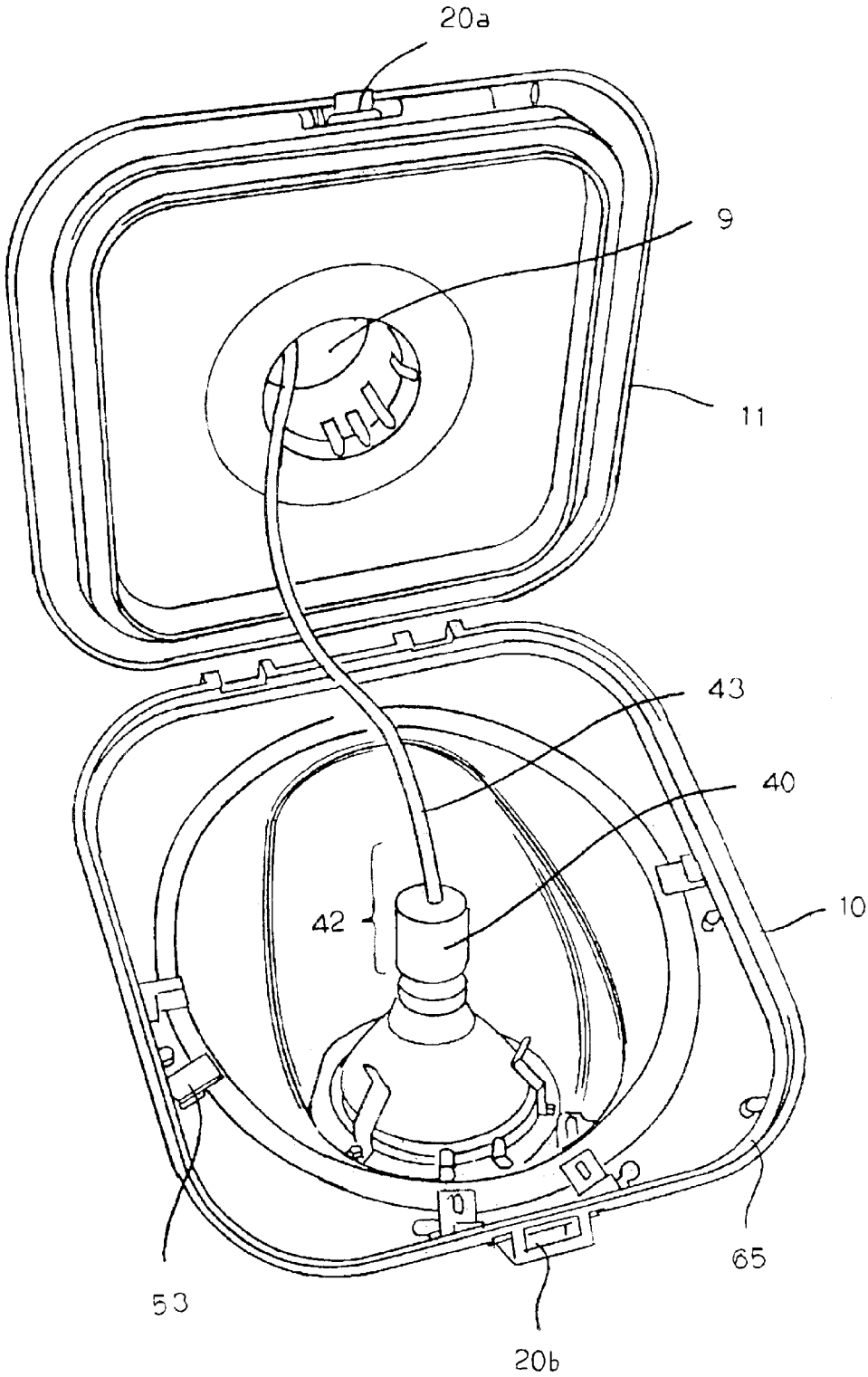
FIG. 6 is a top perspective view of the door frame and shroud portion of the luminaire in an open position away from a luminaire housing.

The directional luminaire 10, as depicted in FIG. 1, comprises a door frame 12 and lamp shroud 14. The door frame 12 is formed with a recessed groove 70. The rim edge 15 of the lamp shroud 14 is formed with a groove 72 of substantially similar dimension to the recessed groove 70 of the door frame. The rim edge 15 of the lamp shroud 14 extends over and is received by the retaining lip 13 of the door frame 12 thereby permitting rotation of the lamp shroud 14 within the door frame 12. The groove 72 of the rim edge 15 of the shroud is formed with a projection or stop 60. The shroud stop 60 as shown in FIG. 5 and a door frame stop interact to limit rotation of the shroud to a single 360° rotation. The shroud is fastened into a particular position of rotation by tightening a locking mechanism, such as a lock nut and clamp assembly 50 as shown in FIGS. 3, 4 and 6. The assembly 50 includes a top clamp portion 53 contacting the rim edge 15 of the lamp shroud and a bottom portion comprising a screw 52 extending from beneath the door frame 12 through a threaded opening in the top clamp portion 53, wherein upon tightening of the screw 52, the top clamp portion 53 presses the shroud 14 and the door frame 12 together and restricts movement of the coupled shroud and door frame.

Figure 2:
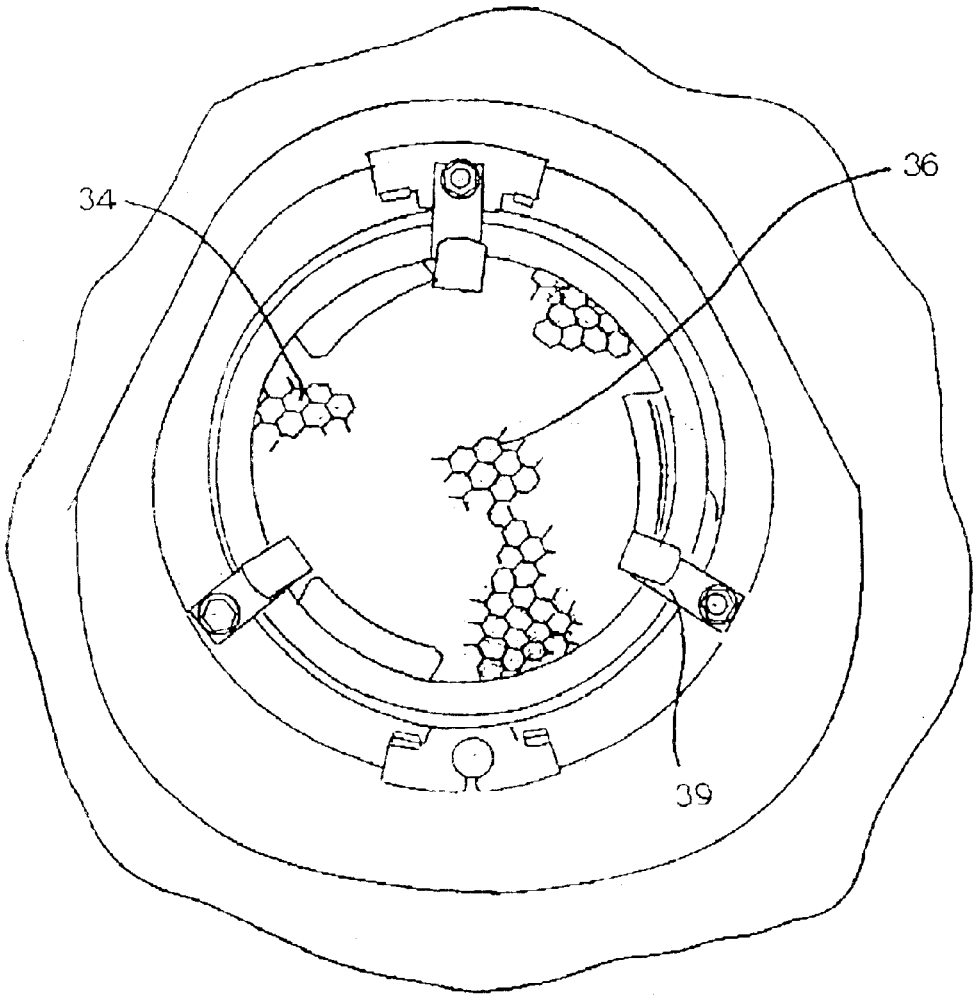
FIG. 2 is a top plan view of a portion of the shroud.

The entire directional luminaire 10 is connected to the support structure with attachment mechanisms, such as the illustrated hinge 18 on one side of the luminaire 10 and a flexible clasp mechanism, such as a spring clasp 20, at the other end. The spring clasp, as shown in FIG. 6, consists of a receiving flexible clasp 20*a* and a clasp bar 20*b* that fits into and is held by the clasp 20*a*. The shroud 14 comprises a rotatable shroud body 30 with an opening 32. The opening is fit with a lens 34, and a baffle 36 which sits atop the lens 34 as shown in FIG. 2. A lamp 38 is located above the opening 32, lens 34 and baffle 36 and is held in place via lamp retaining clips 39 that are attached in a position substantially adjacent to the opening 32, the lens 34, or the baffle 36. The lamp 38 as shown is an incandescent lamp, but could be any type of lamp, including a HID, fluorescent or incandescent lamp. The lamp 38 can be tilted at an angle relative to the opening 32 by raising and placing the lamp edge 56 on tabs 55 that are located at the edge of the opening 32 as depicted in FIG. 4. The lamp lifting tabs 55 can be attached, adjacent to the opening 15, to the shroud 14, the lens 34, or the baffle 36. The end of the lamp 38 is received by a first lamp socket 40 which is connected to a second lamp socket 41 via an adapter 42. The adapter 42 has electrical wiring 43 electrically connected on a first end to the first lamp socket 40 and on a second end to a socket adapter 44. The socket adapter 42 is received by the second lamp socket 41. The second lamp socket 41 is connected to an electrical power source (PS).

As depicted in FIG. 6, the directional luminaire assembly 10 is shown coupled with a luminaire housing structure 11. The door frame 12 is lined with weatherstripping 65 to prevent exterior elements from entering the luminaire 10. The adapter 42 consists of a first lamp socket 40 and electrical wiring 43 that passes through a housing opening 9 and is directly wired into a electrical power source accessible through the housing opening 9.

While the present invention has been illustrated by description of several embodiments which have been described in detail, it is not the intention of the applicant to restrict or in any way limit the scope of the appended claims to such detail. Additional advantages will readily appear to those skilled in the art. Thus, the invention in its broadest aspects is not limited to the specific details, representative apparatus and method, and illustrative examples shown and described. Accordingly, departures may be made from the details without departing from the spirit or scope of applicant's general inventive concept.

What is claimed is:

1. A luminaire adapted for directional adjustment, comprising:

a luminaire support structure;

a door frame attached to the structure;

a rotatable lamp shroud attached to the door frame wherein the lamp shroud has at least one opening; and a lamp socket within the lamp shroud, sized to received the base of a lamp, the lamp socket being electrically connected to a power source and having an electrical contact and being electrically connectable to the base of a lamp when the lamp base is inserted therein.

2. The luminaire of claim 1 wherein the lamp socket and the lamp are directed toward the opening.

3. The luminaire of claim 2 wherein the opening is covered by a lens.

4. The luminaire of claim 3 wherein a baffle is disposed next to the lens inside the lamp shroud.

5. The luminaire of claim 2 wherein the retaining lip of the door frame is formed with a recessed groove to receive the rim edge of the shroud, which is formed with a groove of substantially similar dimensions to that of the door frame.

6. The luminaire of claim 5 wherein the groove of the rim edge is formed with a projection to limit rotation of the lamp shroud within the door frame to a single revolution.

7. The luminaire of claim 5 further comprising one or more clamping mechanisms comprising a top clamp portion contacting the rim edge of the lamp shroud and a bottom portion comprising a screw extending from beneath the door frame through a threaded opening in the top clamp portion, wherein upon tightening of the screw, the clamping mechanisms presses the shroud and the door frame together and restricts movement of the coupled shroud and door frame.

8. The luminaire of claim 4 wherein lamp lifting tabs are attached to the shroud, the lens or the baffle in a position substantially adjacent to the opening.

9. The luminaire of claim 2 wherein the opening is not perpendicular to the structure.

10. The luminaire of claim 3 wherein the lamp is held in position by lamp retaining clips that are attached in a position substantially adjacent to the opening, the lens or the baffle.

11. The luminaire of claim 2 wherein the lamp socket is connected to a second lamp socket in the structure with an adapter.

12. The luminaire of claim 11 wherein the adapter is a wire connector having a first end electrically attached to the lamp socket and a second end electrically attached to a socket adapter for the second lamp socket.

13. The luminaire of claim 2 wherein one side of the door frame is attached to the structure with hinges and the opposite side of the door frame is attached to the structure with a flexible clasp mechanism.

14. A method of installing a retrofit directional luminaire assembly in an existing luminaire, the retrofit directional luminaire having a door frame attached to a support structure, a rotatable lamp shroud attached to the door frame and a lamp socket disposed within the lamp shroud sized to receive a lamp, comprising:

removing an existing door assembly from the support structure of the existing luminaire to expose the interior of the existing luminaire housing;

removing any lamp and reflector from the structure;

providing a door frame having a lamp shroud with at least one opening disposed therein;

providing a lamp socket within the lamp shroud sized to receive the base of a lamp, the lamp socket being electrically connected to an electrical power source and being electrically connectable to the base of a lamp when the lamp base is inserted therein;

providing a lens within the opening of the shroud;

removably suspending the door frame in a substantially vertical, inoperative position;

coupling a set of electrical leads from the power source to the lamp socket;

pivoting the door frame to a horizontal, operative position whereby the door frame substantially closes against the structure; and securing the door frame in the horizontal, operative position.

15. A method of installing a retrofit directional luminaire assembly in an existing luminaire housing, the retrofit directional luminaire having a door frame attached to a support structure, a rotatable lamp shroud attached to the door frame, and a lamp socket disposed within the lamp shroud sized to receive a lamp, comprising:

removing an existing door assembly from the luminaire support structure of the existing luminaire to expose the interior of the existing luminaire housing;

removing any lamp and reflector from the structure;

providing a door frame having a lamp shroud with at least one opening disposed therein;

providing a lamp socket within the lamp shroud sized to received the base of a lamp, the lamp socket having an electrical contact being connected to an electrical power source and being electrically connectable to the base of a lamp when the lamp base is inserted therein;

providing a lens within the opening of the shroud;

removably suspending the door frame in a substantially vertical, inoperative position;

coupling the existing housing lamp socket to the lamp socket using an adapter;

pivoting the door frame to a horizontal, operative position whereby the door frame substantially closes against the structure; and securing the door frame in the horizontal, operative position.

16. A method of installing a luminaire assembly, having a door frame attached to a luminaire support structure, a rotatable lamp shroud attached to the door frame and a lamp socket disposed within the lamp shroud sized to receive a lamp, comprising:

inserting the luminaire housing structure of the luminaire onto a horizontal support structure with the luminaire housing structure inserted from below the horizontal support structure upwardly into an opening in the horizontal support structure;

engaging the luminaire housing structure with a temporary retainer on the horizontal support structure;

holding the luminaire housing structure in the opening with the temporary retainer during installation of the luminaire;

coupling the electrical connection on the lamp socket to an electrical power source;

fixedly securing the luminaire housing structure to the horizontal support structure after the engaging and the holding steps;

providing a door frame having a lamp shroud with at least one opening disposed therein;

providing a lamp socket within the lamp shroud sized to received the base of a lamp, the lamp socket having an electrical contact and being electrically connectable to the base of a lamp when the lamp base is inserted therein;

providing a lens within the opening of the shroud;

removably suspending the door frame in a substantially vertical, inoperative position;

coupling a set of electrical leads from an electrical power source to the lamp socket;

pivoting the door frame to a horizontal, operative position whereby the door frame substantially closes against the luminaire housing structure; and securing the door frame in the horizontal, operative position.

17. The method of claim 16 further comprising forming the opening in the structure prior to inserting the housing therein.

18. The method of claim 16 wherein the housing is solely held by the temporary retainer after the holding step and prior to the fixedly securing step.

* * * * *

UNITED STATES PATENT AND TRADEMARK OFFICE

CERTIFICATE OF CORRECTION

PATENT NO. : 6,802,627 B2
DATED : October 12, 2004
INVENTOR(S) : Jerry F. Fischer et al.

It is certified that error appears in the above-identified patent and that said Letters Patent is hereby corrected as shown below:

Column 6,
Lines 36-37, delete "clamping mechanisms,". Insert -- clamping mechanism --.

Column 7,
Line 34, delete "received". Insert -- receive --.

Column 8,
Line 26, delete "received". Insert -- receive --.

Signed and Sealed this

Fourteenth Day of June, 2005

JON W. DUDAS
*Director of the United States Patent and Trademark Office*